US009549593B2

(12) United States Patent
Kojima et al.

(10) Patent No.: US 9,549,593 B2
(45) Date of Patent: Jan. 24, 2017

(54) SLIDE FASTENER WITH SEPARABLE BOTTOM END STOP

(75) Inventors: Masayoshi Kojima, Toyama (JP); Miyuki Ohgaku, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/008,630

(22) PCT Filed: Mar. 30, 2011

(86) PCT No.: PCT/JP2011/058036

§ 371 (c)(1),
(2), (4) Date: Sep. 30, 2013

(87) PCT Pub. No.: WO2012/131940

PCT Pub. Date: Oct. 4, 2012

(65) Prior Publication Data

US 2014/0020217 A1 Jan. 23, 2014

(51) Int. Cl.
*A44B 19/38* (2006.01)
*A44B 19/24* (2006.01)
(Continued)

(52) U.S. Cl.
CPC ..... *A44B 19/388* (2013.01); *A44B 19/08* (2013.01); *A44B 19/24* (2013.01); *A44B 19/36* (2013.01);
(Continued)

(58) Field of Classification Search
CPC ..... A44B 19/38; A44B 19/388; A44B 19/36
(Continued)

(56) References Cited

U.S. PATENT DOCUMENTS 2,502,885 A * 4/1950 Poux ..... 24/433
2,526,599 A * 10/1950 Bolten, Jr. ..... 24/433
(Continued)

FOREIGN PATENT DOCUMENTS

BR 400951 A 5/2005
CN 1531885 A 9/2004
(Continued)

OTHER PUBLICATIONS

Extended EP Search Report, EP Application No. 11 862 682.9, Nov. 20, 2014.
(Continued)

*Primary Examiner* — Robert J Sandy
*Assistant Examiner* — Jason W San
(74) *Attorney, Agent, or Firm* — Kilpatrick Townsend & Stockton LLP

(57) ABSTRACT

The slide fastener has a separable bottom end stop, and the separable bottom end stop has at least an insert pin and a box pin. The insert pin has an escape portion provided with an inclined surface or a curved surface along which the thickness dimension of the insert pin decreases in the direction of the tape width toward the side edge that faces the box pin, the escape portion being positioned in the front-end corner portion of a first-surface of the insert pin, the corner portion being positioned along the edge that faces the box pin. This allows the escape portion of the insert pin to function as an interference prevention means, efficiently prevent chain failure in an element row when the slide fastener is bent into a U-shape, and maintain stable engaging.

7 Claims, 7 Drawing Sheets

(51) Int. Cl.
*A44B 19/08* (2006.01)
*A44B 19/36* (2006.01)

(52) U.S. Cl.
CPC ..... *A44B 19/382* (2013.01); *Y10T 24/2598* (2015.01)

(58) Field of Classification Search
USPC ..... 24/433, 434
See application file for complete search history.

(56) References Cited

U.S. PATENT DOCUMENTS

| | | | | |
|---|---|---|---|---|
| 2,892,231 | A * | 6/1959 | Ulrich et al. | 24/388 |
| 3,046,627 | A * | 7/1962 | Morin | 24/433 |
| 3,507,013 | A * | 4/1970 | Inazawa | 24/434 |
| 4,078,279 | A * | 3/1978 | Heimberger | 24/434 |
| 4,090,279 | A * | 5/1978 | Wasko | 24/386 |
| 4,221,026 | A * | 9/1980 | Kanzaka | 24/433 |
| 4,571,784 | A * | 2/1986 | Okazaki | 24/433 |
| 4,586,220 | A * | 5/1986 | Ogura et al. | 24/433 |
| 5,131,120 | A * | 7/1992 | Akashi | 24/433 |
| 5,586,370 | A * | 12/1996 | Fudaki | 24/433 |
| 6,009,602 | A * | 1/2000 | Terada | 24/433 |
| 6,195,852 | B1 * | 3/2001 | Kusayama | 24/434 |
| 6,615,458 | B2 * | 9/2003 | Takasawa et al. | 24/433 |
| 6,826,810 | B2 * | 12/2004 | Ichikawa et al. | 24/433 |
| 7,340,806 | B2 * | 3/2008 | Matsumoto et al. | 24/433 |
| 7,690,089 | B2 * | 4/2010 | Keyaki et al. | 24/386 |
| 7,694,396 | B2 * | 4/2010 | Ogura | 24/433 |
| 7,882,602 | B2 * | 2/2011 | Himi | 24/433 |
| 8,402,614 | B2 * | 3/2013 | Fujii | 24/433 |
| 8,806,725 | B2 * | 8/2014 | Keyaki et al. | 24/433 |
| 8,844,101 | B2 * | 9/2014 | Nozaki et al. | 24/433 |
| 2003/0115725 | A1 * | 6/2003 | Matsumoto et al. | 24/433 |
| 2003/0213107 | A1 * | 11/2003 | Mizuhara et al. | 24/433 |
| 2004/0181919 | A1 * | 9/2004 | Mizuhara et al. | 24/387 |
| 2004/0181920 | A1 * | 9/2004 | Mizuhara et al. | 24/387 |
| 2004/0205942 | A1 | 10/2004 | Tsaur | |
| 2005/0050699 | A1 * | 3/2005 | Yoneoka | 24/433 |
| 2005/0278904 | A1 * | 12/2005 | Matsumoto et al. | 24/433 |
| 2006/0282998 | A1 * | 12/2006 | Kusayama et al. | 24/434 |
| 2008/0092347 | A1 * | 4/2008 | Ogura | 24/433 |
| 2009/0094805 | A1 * | 4/2009 | Keyaki et al. | 24/433 |
| 2010/0299887 | A1 | 12/2010 | Lin | |
| 2012/0124788 | A1 * | 5/2012 | Keyaki | A44B 19/382 24/386 |
| 2012/0167354 | A1 * | 7/2012 | Keyaki | A44B 19/388 24/386 |
| 2013/0074292 | A1 * | 3/2013 | Nozaki et al. | 24/415 |
| 2013/0074293 | A1 * | 3/2013 | Mikuma | 24/430 |

FOREIGN PATENT DOCUMENTS

| | | | |
|---|---|---|---|
| CN | 1883329 | A | 12/2006 |
| EP | 1459642 | A1 | 9/2004 |
| JP | 39-10633 | Y1 | 4/1964 |
| JP | 2004-283299 | A | 10/2004 |
| JP | 2006-346364 | A | 12/2006 |
| KR | 10-2004-0082979 | A | 9/2004 |
| WO | 2010/082294 | A1 | 7/2010 |
| WO | WO 2011013232 | A1 * | 2/2011 |

OTHER PUBLICATIONS

International Search Report, PCT Application No. PCT/JP2011/058036 mailed Apr. 26, 2011.

* cited by examiner

SLIDE FASTENER WITH SEPARABLE BOTTOM END STOP

This application is a national stage application of PCT/JP2011/058036 which is incorporated herein by reference.

TECHNICAL FIELD

The invention relates to a slide fastener with a separable bottom end stop and in particular to a slide fastener with a separable bottom end stop capable of preventing an occurrence of engagement failure to an element row even if a fastener tape is bent at a position adjacent to the insert pin and the box pin.

BACKGROUND ART

Conventionally, a synthetic resin fastener element formed one by one by injection molding a synthetic resin to a fastener tape, a continuous fastener element formed by molding a mono filament in a coil shape or in a zigzag shape, a metal fastener element formed by caulking a metal element material exhibiting an approximately Y-shape to a fastener tape, and the like are known as a fastener element used in a slide fastener.

The synthetic resin fastener element is generally molded so as to stride across a tape front surface that is a first surface of the fastener tape and a back surface that is a second surface of fastener tape and has an element upper half portion disposed to a tape front surface side of the fastener tape and an element lower half portion disposed to a back surface side of the fastener tape.

Further, although in many cases the synthetic resin fastener elements are molded so that the element upper half portion and the element lower half portion are formed in a symmetric shape, the element upper half portion and the element lower half portion may be formed in an asymmetric different shape to improve, for example, beauty and a feeling of touch (property perceived by touch) of a fastener element.

An example of the fastener element having the shape in which the element upper half portion is different from the element lower half portion as described above is disclosed in, for example, WO 2010/082294 A (Patent Document 1), and the like.

Here, the synthetic resin fastener element described in Patent Document 1 will be explained referring to FIG. 9. Note that, in the following explanation, a tape length direction of the fastener tape is prescribed as a front/back direction. Further, a tape width direction of the fastener tape is prescribed as a right/left direction, and a tape front/back direction of the fastener tape is prescribed as an up/down direction.

A fastener element 60 of Patent Document 1 has an element upper half portion 61 disposed to a first surface side of a fastener tape 70 and an element lower half portion 62 disposed to the second surface side of the fastener tape 70. The element upper half portion 61 includes a first tape sandwiching portion 61*a* for sandwiching the fastener tape 70 between the first tape sandwiching portion 61*a* and the element lower half portion 62, and a first head portion 61*b* in a tapered form extending from the first tape sandwiching portion 61*a* toward external of the tape.

The first tape sandwiching portion 61*a* in the element upper half portion 61 and a part of the first head portion 61*b* are provided with front and back taper portions 61*c*, which gradually decrease a dimension of the element upper half portion 61 in a front/back direction toward upward, on front and back side surfaces. The disposition of the front and back taper portions 61*c* can cause an outside appearance of the fastener element 60 to be viewed as if it is a metal fastener element 60 when the fastener element 60 is viewed from a front surface side. Further, since the provision of the element upper half portion 61 with the front and back taper portions 61*c* can more increase a dimension of the first tape sandwiching portion 61*a* at its lower end in an up/down direction (element width dimension) than its upper edges, a fixing strength of the fastener element 60 to the fastener tape 70 can be increased.

Further, the first head portion 61*b* in the element upper half portion 61 is formed in a taper shape so that a dimension of the first head portion 61*b* in the tape length direction gradually decreases from a base end portion joined to the first tape sandwiching portion 61*a* toward an forefront portion. With the configuration, the outside appearance of the fastener element 60 can be made further closer to the metal fastener element 60.

The first head portion 61*b* is configured to swell in the front/back direction than a neck portion 62*b* to be described later of the element lower half portion 62. With the configuration, even when the right/left fastener elements 60 receives a force for pushing them up from a lower direction to an upper direction, since the first head portion 61*b* can support the element lower half portion 62 (in particular, a second head portion 62*c* to be described later) that is a engagement opponent, an occurrence of the engagement failure (also referred to as chain failure) can be prevented from being occurred and a engaged state of the fastener element 60 can be kept stable.

Further, the element upper half portion 61 is formed with an upper taper portion 61*d*, which inclines downward to gradually decrease a height dimension of the fastener element 60 in the up/down direction toward an forefront portion of the first head portion 61*b*, as an interference avoiding portion to be described later.

The element lower half portion 62 of the fastener element 60 is formed integrally with the element upper half portion 61. The element lower half portion 62 includes a second tape sandwiching portion 62*a* for sandwiching the fastener tape 70 between a second tape sandwiching portion 62*a* and the first tape sandwiching portion 61*a* of the element upper half portion 61, the neck portion 62*b* extending from the second tape sandwiching portion 62*a* toward external of the tape and having a shape narrowed in the front/back direction, and the second head portion 62*c* disposed at an forefront portion of the neck portion 62*b* and swelling in the front/back direction.

Note that, in Patent Document 1, when the right/left element rows are engaged, since the right/left fastener elements 60 are engaged with each other only in the element lower half portion 62, engaging strength becomes weak as compared with an ordinary type fastener element having a shape in which the element upper half portion 61 is in symmetry with the element lower half portion 62.

Since the slide fastener according to Patent Document 1 which is configured such that the synthetic resin fastener elements 60 having the configuration described above are disposed to the fastener tape 70 side by side exhibits an outside appearance as if the respective fastener elements are metal fastener elements 60 when viewed from the front surface side, the slide fastener is excellent in outside appearance quality and a design property.

Further, in the slide fastener, the upper taper portion 61*d* described above is formed to the element upper half portion 61 of the fastener element 60 of each of the fastener elements as an interference avoiding portion. Accordingly, when the slide fastener is bent to the tape first surface side so that the element upper half portions 61 approach each other in the engaged state of the fastener element 60, the first head portions 61*b* of the respective fastener elements 60 can be prevented from interfering with the element upper half portions 61 of the engagement opponent.

To explain more specifically, when the slide fastener is bent in a direction where the element upper half portions approach each other in the engaged state of the fastener element at, for example, the time that the upper taper portion 61*d* as in Patent Document 1 is not disposed to the element upper half portion 61, the first head portion of the element upper half portion interferes with the element upper half portion of a engagement opponent side, and the element lower half portions of the fastener elements adjacent to each other on the engagement opponent sides are turned in a direction where they are away from each other using the interfering portion as a fulcrum. As a result, a large expansion of the interval between the second head portions of the fastener element causes the right/left fastener elements to disengage, from which a problem arises in that chain failure occurs.

In contrast, in Patent Document 1, the disposition the upper taper portion 61*d* to the element upper half portion 61 of the fastener element 60 prevents the element upper half portion 61 of the engagement opponent side from interfering with the first head portion 61*b* of the fastener element 60 when the slide fastener is bent to the tape first surface side as described above.

In the case, since the element upper half portions 61 adjacent to each other in the tape length direction come into contact with each other before the right/left fastener elements 60 are released from a engaged state, so that a bent amount of the slide fastener can be regulated. Accordingly, in the slide fastener according to Patent Document 1, even if the slide fastener is bent in an U-shape, since the second head portions 62*c* of the fastener elements 60 can be prevented from being away from each other until the fastener elements 60 are released from the engaged state, a problem that the chain failure occurs to the element row as described above can be overcome.

Incidentally, also known as the conventional slide fastener are a type of a slide fastener which can be opened from both end sides of an element row in a length direction and a type of a slide fastener which can be closed from both end sides of an element row in addition to an ordinary slide fastener of a type in which the slide fastener can be opened or closed from an end side toward other end side of an element row in a length direction.

For example, in the ordinary slide fastener, a separable bottom end stop is composed of an insert pin attached to an end of a fastener stringer and a box pin and a box attached to an end of the other fastener stringer. Hereinafter, the separable bottom end stop will be called a one side separable bottom end stop.

In contrast, the slide fastener which can be opened from both the end sides of the element row is disclosed in, for example, JP 2006-346364 A (Patent Document 2) and the like, has two sliders slidably disposed along an element row with rear ports facing each other, an insert pin attached to an end of a fastener stringer, and a box pin attached to an end of the other fastener stringer, and a separable bottom end stop is composed of the two sliders, the insert pin, and the box pin. Hereinafter, the separable bottom end stop will be called a both sides separable bottom end stop.

PRIOR ART DOCUMENT

Patent Document

Patent Document 1: WO 2010/082294 A
Patent Document 2: JP 2006-346364 A

SUMMARY OF THE INVENTION

Problem to be Solved by the Invention

In the slide fastener according to Patent Document 1, since the upper taper portion 61*d* is disposed to the fastener element 60 as the interference avoiding portion as described above, when the slide fastener is bent to the tape first surface side in the engaged state of the fastener element 60, it is avoided for the element upper half portions 61 to interfere with each other between the engaged fastener elements 60, so that the occurrence of chain failure is prevented.

However, in the conventional slide fastener, when the one side separable bottom end stop or the both sides separable bottom end stop is disposed to ends of the right/left fastener stringers, that is, when the slide fastener is bent into the U-shape to a tape first surface side at a position adjacent to the insert pin and the box pin in, for example, the state that the fastener elements are engaged, any means is not provided to prevent a fastener element (hereinafter, referred to as a first element) from interfering with an insert pin engaged with the first element.

Accordingly, when the slide fastener at the position adjacent to the insert pin and the box pin is bent as described above, since the first element interferes with the insert pin using the interfered portion as a fulcrum, the fastener element is pressed to a tape second surface side (downward) by the insert pin.

As a result, a problem arises in that an element lower half portion of the first element is pushed downward so as to be away from the insert pin and an opponent fastener element adjacent to the insert pin and the first element engaged with the insert pin and the opponent fastener element is released therefrom and thus chain failure occurs using the first element as an origin.

A specific object of the invention which was achieved in view of the conventional problem is to provide a slide fastener with the separable bottom end stop capable of preventing an occurrence of chain failure to an element row by avoiding an insert pin interfering with a fastener element even if a slide fastener is bent to a tape first surface side at a position adjacent to the insert pin and the box pin.

Means for Solving the Problems

To achieve the above object, a most significant feature of a slide fastener with separable bottom end stop provided by the invention comprises, as a basic configuration, a pair of first and second fastener stringers in which element rows are disposed wherein a plurality of fastener elements made of synthetic resin are molded along a tape length direction at predetermined intervals at facing respective tape side edges of first and second fastener tapes and separable bottom end stop disposed to one end of each of the first and second fastener stringers, the separable bottom end stop including at least an insert pin attached adjacent to the element row of the first fastener stringer and a box pin attached adjacent to the element row of the second fastener stringer, wherein at least a corner portion of a front end of the insert pin on a facing side edge side that faces the second fastener stringer includes an escape portion which avoids interference with the fastener element disposed adjacent to the box pin when the fastener elements are coupled, and the escape portion has an inclined surface which declines downward or a concave curved surface, and a thickness dimension of the insert pin in a tape front/back direction gradually decreases continuously from a main body portion towards a front end edge of the insert pin.

In the slide fastener with separable bottom end stop according to the invention, it is preferable that a dimension of the escape portion of the front end of the insert pin in the tape front/back direction gradually decreases as the escape portion extends toward the front end edge in the tape length direction throughout the tape width direction of the escape portion.

It is preferable that the escape portion is configured so as to exhibit an approximately triangular shape including a front end edge on the element row side and the facing side edge as two sides when the insert pin is viewed from a front surface side.

It is preferable that the escape portion is disposed in a front end region within 10% of the entire length in the tape length direction from the front end edge on the element row side in the insert pin. Further, it is preferable that an inclined angle of the escape portion to the first surface of the insert pin is set equal to or more than 15° and less than 90°.

Further, in the slide fastener with separable bottom end stop of the invention, it is preferable that a notch portion is disposed at a position nearer to a facing side edge side that faces the second fastener stringer than the escape portion of the corner portion.

Further, an inclined surface formed by gradually decreasing a dimension of the fastener element in the tape front/back direction toward a forefront portion of the fastener element in the tape width direction, is disposed on a first surface side that is a surface of a fastener element that configures the element row.

Effect of the Invention

In the slide fastener with separable bottom end stop according to the invention, the escape portion having the inclined surface or the curved surface for gradually decreasing the dimension (thickness dimension) of the insert pin in the tape front/back direction toward the facing side edge in the tape width direction is disposed at the corner portion facing the second fastener stringer on the front end side in a first surface side of the insert pin which configures the separable bottom end stop.

The provision of the escape portion with the insert pin can cause the escape portion to function as an interference avoiding means for avoiding, when the slide fastener is bent into the U-shape at positions adjacent to the insert pin and the box pin, a fastener element (hereinafter, the fastener element is referred to as a first element) disposed adjacent to the box pin from interfering with the insert pin.

Accordingly, even if the slide fastener is bent into the U-shape to a tape first surface side at the positions adjacent to the insert pin and the box pin in a state that right/left fastener elements are engaged, since the first element does not interfere with the insert pin by providing the escape portion as described above or even if the insert pin interferes with the first element, since an amount of interference therebetween can be reduced, the first element can be prevented from being pushed so as to be away from being engaged with the insert pin or an opposing fastener element.

Accordingly, it can be effectively prevented that chain failure occurs to an element row due to an interference between the insert pin and the first element as in a conventional slide fastener, so that an engaged state of the right/left fastener elements can be stably maintained. Note that, in the invention, the above-mentioned corner portion disposed to a first surface side of the insert pin is a portion of an extent (region) on a front end side in the insert pin as well as on a facing side edge facing the second fastener stringer.

In the slide fastener with separable bottom end stop of the invention, the escape portion has the inclined surface or the curved surface as mentioned above. With the operation, the interference between the insert pin and the first element can be more effectively prevented and further the escape portion can be used also as a chamfering portion, so that quality of an outside appearance of the insert pin can be improved.

Further, the escape portion is configured so as to exhibit an approximately rectangular shape including the front end edge on the element row side and the facing side edge as two sides when the insert pin is viewed from a front surface side. For example, when the size of the escape portion disposed to the insert pin is excessively large, there is a fear that the strength of the insert pin itself is lowered because the thickness of the insert pin in the escape portion is reduced. In contrast, since the thickness dimension of the insert pin at the corner portion can be efficiently reduced by configuring the escape portion so as to exhibit the approximately triangular shape, the interference between the insert pin and the first element is stably prevented as well as a drop of strength of the insert pin can be suppressed.

Further, the escape portion is disposed in a front end region within 10% from the front end edge on the element row side in the insert pin. With the configuration, the escape portion can be disposed in an appropriate size, so that a drop of strength of the insert pin itself and deterioration of the quality of the outside appearance of the insert pin can be suppressed.

Further, an inclined angle of the escape portion to the first surface of the insert pin is set equal to or more than 15° and less than 90° and preferably more than 20° and less than 45°. When the inclined angle of the escape portion is set equal to or more than 15° and preferably set equal to or more than 20°, the interference between the insert pin and the first element can be more effectively avoided in the escape portion. Further, when the inclined angle of the escape portion is less than 90° and preferably equal to or less than 45°, the quality of the outside appearance of the insert pin is also not deteriorated.

Further, in the slide fastener with separable bottom end stop of the invention, a notch portion is disposed at the position nearer to the facing side edge side that faces the second fastener stringer than the escape portion of the corner portion. With the configuration, when the slide fastener is bent into the U-shape at the position adjacent to the insert pin and the box pin, the interference between the first element and the insert pin can be effectively avoided.

Further, in the slide fastener with separable bottom end stop of the invention, the inclined surface is disposed on the first surface side that is the surface of the fastener element that configures the element row as mentioned above. With the configuration, even if the slide fastener is bent into the U-shape, the interference between the insert pin and the first element can be avoided as well as the interference between the right/left fastener elements can be also avoided, so that an occurrence of chain failure in the right/left element rows in a engaged state can be more effectively prevented.

MODE(S) FOR CARRYING OUT THE INVENTION

Hereinafter, preferable embodiments of the invention will be explained in detail with examples and referring to drawings. Note that the invention is by no means limited to the respective embodiments explained below and can be variously modified as long as the embodiments have substantially the same configuration and achieve a similar operation/working-effect. Modes of respective fastener elements for configuring, for example, an element row of a slide fastener are not limited to the mode explained in the embodiments described below and can be optionally changed when necessary.

Embodiment 1

Figure 1:
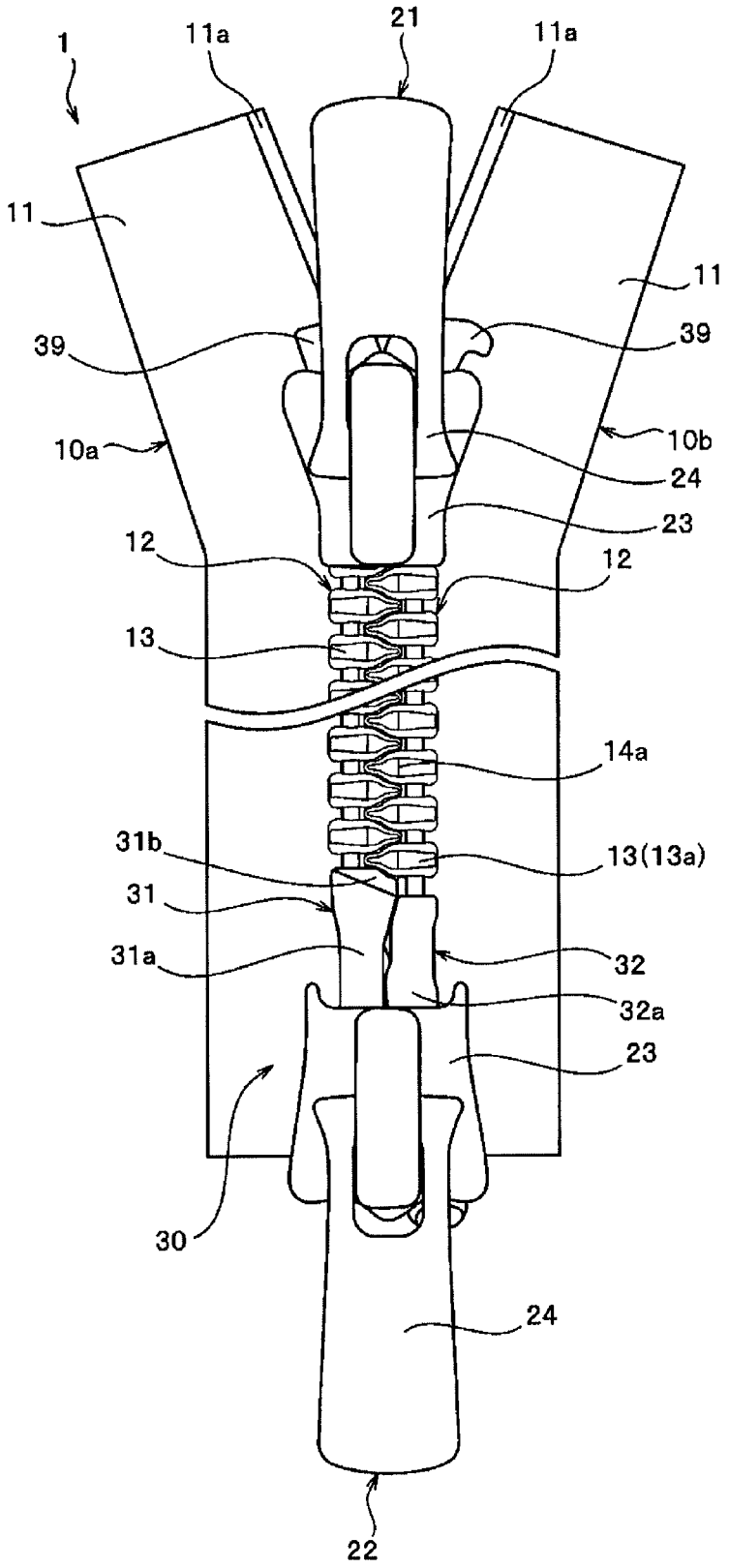
FIG. 1 is a front view illustrating a slide fastener according to Embodiment 1 of the invention.
Figure 2:
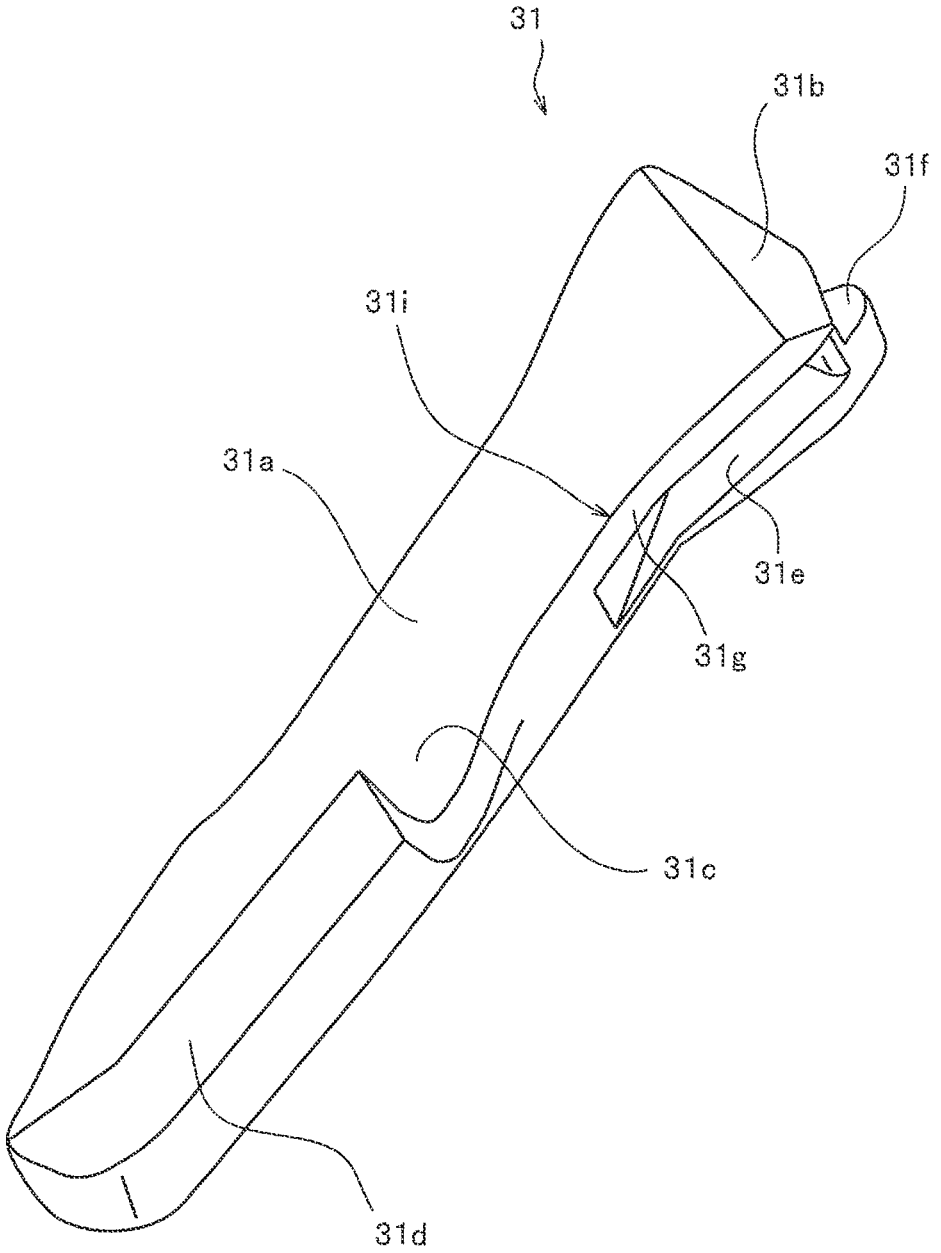
FIG. 2 is a perspective view illustrating an insert pin disposed to the slide fastener.

FIG. 1 is a front view illustrating a slide fastener according to Embodiment 1, and FIG. 2 is a perspective view illustrating an insert pin disposed to the slide fastener. Note that, in the following explanation, a tape length direction of the fastener tape is prescribed as a front/back direction, and in particular, a direction in which a slider is away from a separable bottom end stop is prescribed as a forward direction and a direction in which the slider is slid toward the separable bottom end stop is prescribed as a rearward direction. A tape width direction of the fastener tape is prescribed as a right/left direction, and, in particular, a left side when the slide fastener is viewed from a front side as illustrated in FIG. 1 is prescribed as left, and a right side is prescribed as right. Further, a tape front/back direction of the fastener tape is prescribed as an up/down direction, a side where a tab of the slider is disposed to a tape surface of the fastener tape is prescribed as upward, and a side opposite to the above side is prescribed as downward.

As shown in FIG. 1, a slide fastener 1 according to Embodiment 1 includes a pair of first and second right/left fastener stringers 10*a*, 10*b* having element rows 12 disposed to facing tape side edges of right/left fastener tapes 11, a set of first and second upper/lower sliders 21, 22 slidably disposed along the element rows 12, an insert pin 31 disposed to a lower end of the first left fastener stringer 10*a*, a box pin 32 disposed to a lower end of the second right fastener stringer 10*b*, and a stop 39 attached to upper ends of the first and second fastener stringers 10*a*, 10*b* along the element rows 12. In the case, a separable bottom end stop 30 of the slide fastener 1 is composed of the second slider 22, the insert pin 31, and the box pin 32.

Each of the first and second fastener stringers 10*a*, 10*b* includes the fastener tapes 11, and a plurality of synthetic resin fastener elements 13 disposed to a tape side edge of the fastener tapes 11. The respective right/left fastener tapes 11 are woven or knitted in a narrow strip-shape and have a tape main portion which is sewed to a product to which a fastener is attached and an element attachment portion (tape side edge) to which a fastener element 13 is attached. Further, a core thread portion 11*a* is disposed to a tape side edge on an element attachment portion in the fastener tapes 11.

In the right/left fastener tapes 11, the plurality of synthetic resin fastener elements 13 is disposed in train to the element attachment portion including the core thread portion 11*a* by injection molding in the tape length direction at predetermined intervals and the element row 12 is formed by the plurality of fastener elements 13. In the invention, in the fastener elements 13 which configure the right element row 12, the fastener element 13 disposed adjacent to the box pin 32 is referred to as a first element 13*a* as described above.

Note that a material of the fastener element 13 is not limited and a synthetic resin, for example, such as polyacetal, polyamide, polypropylene, polybutylene terephthalate, nylon, polycarbonate, and the like can be preferably used, and the fastener element 13 formed of the synthetic resin has a weight lighter than the metal fastener element.

Figure 9:
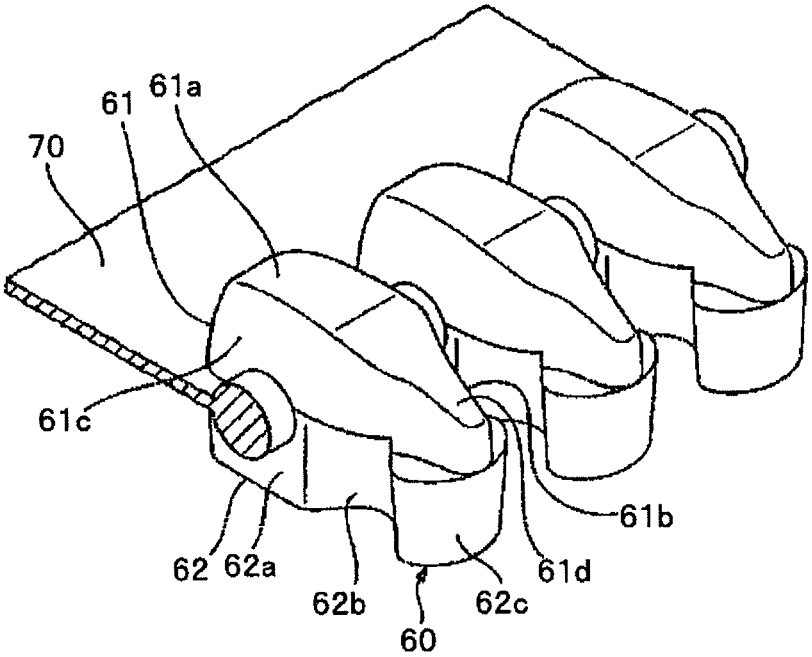
FIG. 9 is an enlarged view illustrating a main portion of a conventional slide fastener.

The fastener element 13 of Embodiment 1 is configured including substantially the same configuration as the fastener element illustrated in FIG. 9 described in Patent Document 1. To simply explain the configuration referring to FIG. 4, the fastener element 13 of Embodiment 1 has an element upper half portion 14 disposed to an upper surface (front surface) side which becomes a first surface of the fastener tapes 11 and an element lower half portion 15 disposed to a lower surface (back surface) side which becomes a second surface of the fastener tapes 11, and the element upper half portion 14 includes a first tape sandwiching portion and the first head portion extending from the first tape sandwiching portion toward external of a tape.

Further, forward and rearward taper portions, which gradually decrease the forward/rearward dimension of the element upper half portion 14 upward are disposed to a forward surface side and to a rearward side surface, of the first tape sandwiching portion and a part of the first head portion in the element upper half portion 14, so that an outside appearance of the fastener element 13 appears as if it is a metal fastener element as well as fixing strength of the fastener element 13 to the fastener tapes 11 are increased. In the case, an inclined angle to an up/down direction of the forward and rearward taper portion in the element upper half portion 14 is set to approximately 10°.

The first head portion in the element upper half portion 14 extends up to an forefront portion of the element lower half portion 15 and is formed in a taper shape whose dimension in the front/back direction is gradually decreased from a base end portion joined to the first tape sandwiching portion of the first head portion toward the forefront portion. Further, the first head portion is configured to swell in the front/back direction than a neck portion of the element lower half portion 15 to be described later. Further, the element upper half portion 14 is formed with an upper taper portion having a inclined surface that inclines downward to gradually decrease a height dimension of the fastener element 13 toward an forefront of the first head portion.

In the case, an inclination start portion 14*a* from which the downward inclination of the upper taper portion begins is set at a position where a dimension from a forefront of the first head portion to the inclination start portion 14*a* in the direction of the tape width is made to a magnitude of 45% in the overall fastener element 13 in the direction of the tape width, and further an inclined angle of the upper taper portion in the right/left direction is set to approximately 20°.

The element lower half portion 15 in the fastener element 13 is formed integrally with the element upper half portion 14. The element lower half portion 15 includes a second tape sandwiching portion for sandwiching the fastener tapes 11 between element lower half portion 15 and the first tape sandwiching portion of the element upper half portion 14, a neck extending from the second tape sandwiching portion toward external of the tape and having a shape narrowed in the front/back direction, and a second head portion disposed to a forefront of the neck and becoming large in the front/back direction.

The first and second sliders 21, 22 in Embodiment 1 are configured substantially similarly to two sliders used in a slide fastener having a conventional both sides separable bottom end stop and disposed to cause rear ports thereof to face with each other, as shown in FIG. 1. Here, the first slider 21 is disposed near to the stop 39 side (forward side) than the second slider 22 and is used as a front opening slider for coupling the right/left element rows 12 when the first slider 21 is slid toward the stop 39 side. Further, the second slider 22 is disposed nearer to an openable/engageable side (rearward side) than the first slider 21 and is used as a rear opening slider for departing the right/left element rows 12 when the second slider 22 is slid toward the stop 39.

Further, each of the first and second sliders 21, 22 includes a slider body 23 and a tab 24 turnably held by the slider body 23. The slider body 23 of each of the sliders 21, 22 has upper/lower blades, a guide column for coupling between one ends of the upper/lower blades, right/left flange portions extending from right/left side edges of the upper/lower blades in a direction where they approach each other, and a tab attachment column standingly disposed on an upper surface of the upper blade.

Right/left shoulder ports are formed to an end of the slider body 23 with the guide column held therebetween and a rear port is formed to a rear end of the slider body 23. Further, an approximately Y-shaped element guide path for communicating the right/left shoulder ports to the rear port is formed between the upper/lower blades, and tape insertion intervals capable of inserting the fastener tapes 11 are disposed to right/left sides of the slider body 23.

The insert pin 31 in Embodiment 1 is disposed adjacent to the element row 12 so as to be continuous from a rear end of the element row 12 in the first left fastener stringer 10*a* and is fixed across both tape front/back surfaces of the fastener tapes 11. The insert pin 31 is formed by injection molding the same synthetic resin material as the fastener element 13 such as polyacetal, and the like.

Figure 3:
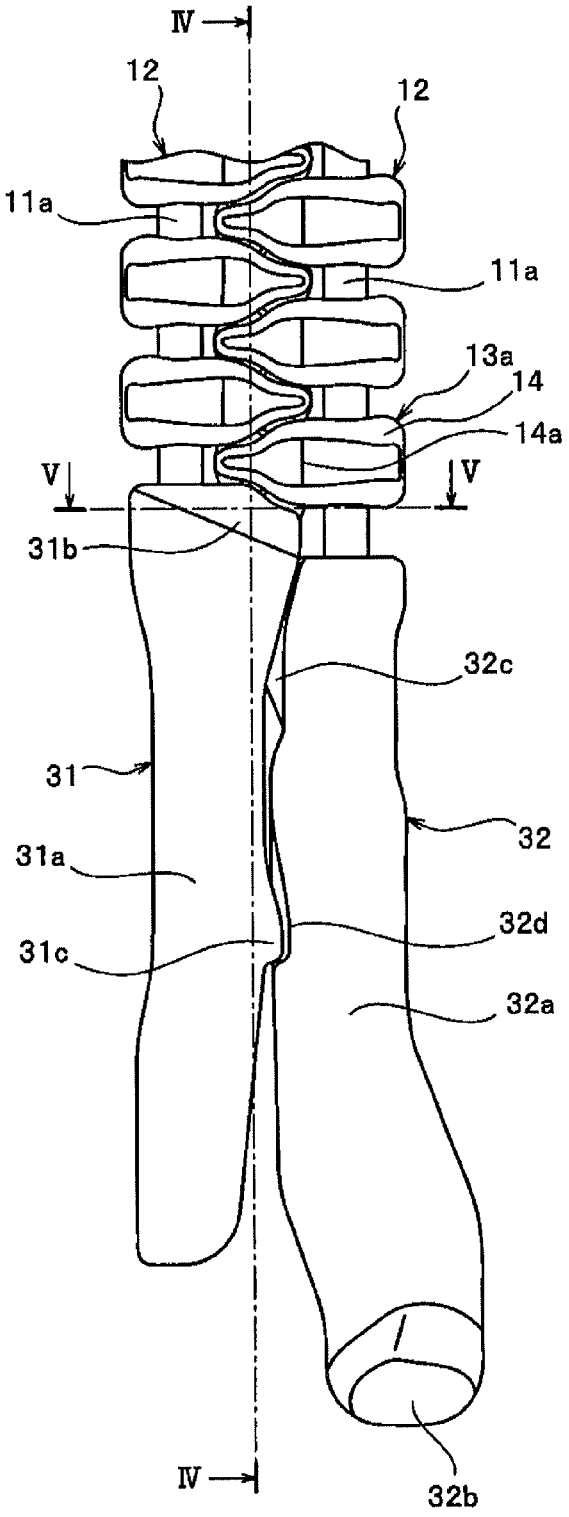
FIG. 3 is a schematic view illustrating states of an insert pin, a box pin, and a fastener element when the slide fastener is closed.

Further, as shown in FIGS. 1 to 3, the insert pin 31 has an insert pin main body 31*a* fixed to the fastener tapes 11, a first tapered portion 31*b* formed to a front end near to the element row 12 of the insert pin main body 31*a* as an escape portion, a projecting portion 31*c* disposed to a central portion of the insert pin 31 in a length direction and projects in the direction of the tape width toward the box pin 32 side, a second tapered portion 31*d* disposed to a rear side of the projecting portion 31*c*, an accommodation concave portion 31*e* recessed in the direction of the tape width from a box pin facing a side surface in a front end of the insert pin main body 31*a*, and an element engaging portion 31*f* projecting forward from the front end of the insert pin main body 31*a*.

The first tapered portion 31*b* acting as the escape portion in the insert pin 31 is configured such that it is disposed to an upper surface side of an insert pin front end including a front-end corner portion on a facing side surface side 31*g* that confronts the box pin 32 in an upper half portion of the insert pin main body 31*a*, and when the insert pin 31 is viewed from a front surface side (upper surface side), the first tapered portion 31*b* exhibits an approximately triangular shape including a front end edge of the insert pin 31 and a box pin facing side edge 31*i* as two sides. In the case, the first tapered portion 31*b* is disposed in a front end region within 10% of the entire length from the front end edge of the insert pin 31 in the tape length direction.

Figure 4:
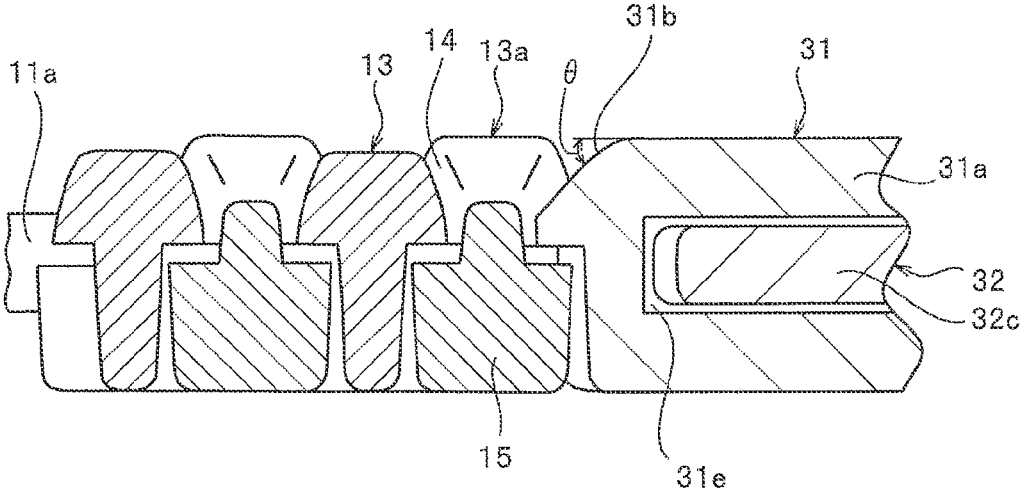
FIG. 4 is a portional view taken along a IV-IV line illustrated in FIG. 3.
Figure 5:
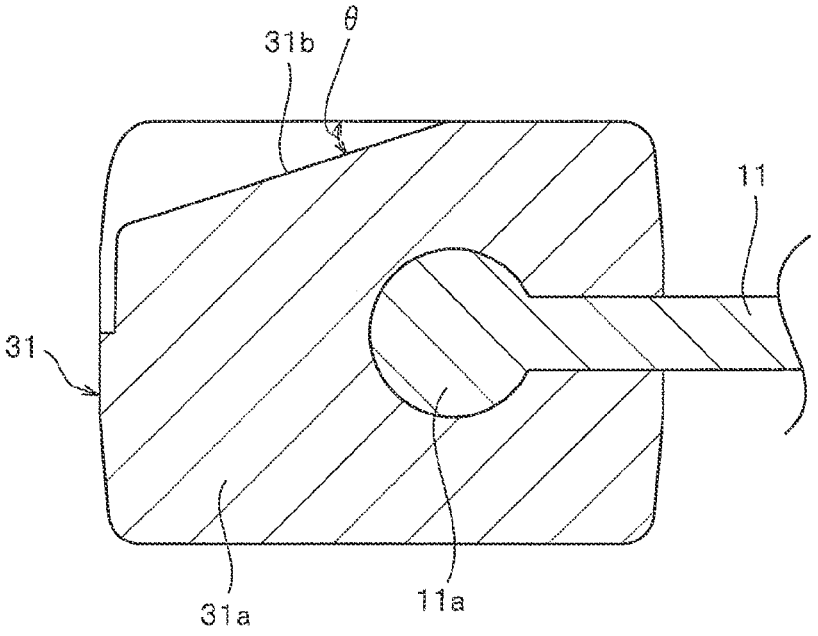
FIG. 5 is a portional view of the insert pin in the V-V line illustrated in FIG. 3.

Further, the first tapered portion 31*b* is composed of a flat inclined surface including an inclination for gradually decreasing a thickness of the insert pin 31 in the tape front/back direction toward the side edge that faces the box pin in the direction of the tape width as illustrated in FIG. 5 as well as in FIG. 4.

Note that, in the invention, the escape portion formed to the insert pin 31 is not restricted to an inclined surface such as the first tapered portion 31*b* and may be composed of a curved surface in which the thickness dimension of the insert pin 31 in the tape front/back direction is gradually decreased toward the side edge that faces the box pin in the direction of the tape width as well as also gradually decreased toward the insert pin front end edge in the tape length direction. In the case, the curved surface that constitutes the escape portion may be externally curved in a convex shape or in a concave shape. When, for example, a high value is set on an outside appearance of the insert pin, it is preferable to form the curved surface in the convex shape, whereas when a high value is set on a function as the escape portion, it is preferable to form the curved surface in the concave shape.

In Embodiment 1, the provision of the first tapered portion 31*b* as described above as the escape portion decreases a thickness dimension of an upper half portion of the insert pin 31 in the front-end corner portion on a box pin facing side surface side, and the first tapered portion 31*b* can be used as an interference avoiding means for avoiding the insert pin 31 from interfering with the first element 13*a* each other as described later. Further, the first tapered portion 31*b* can be used also as a chamfered portion.

In particular, since the first tapered portion 31*b* of Embodiment 1 is disposed in the approximately triangular shape in the front end corner region of the first surface of the insert pin 31 as described above, the thickness dimension of the insert pin 31 in the corner portion can be efficiently decreased without increasing a region in which the first tapered portion 31*b* is formed and a strength of the insert pin 31 itself can be also suppressed from being decreased.

Figure 6:
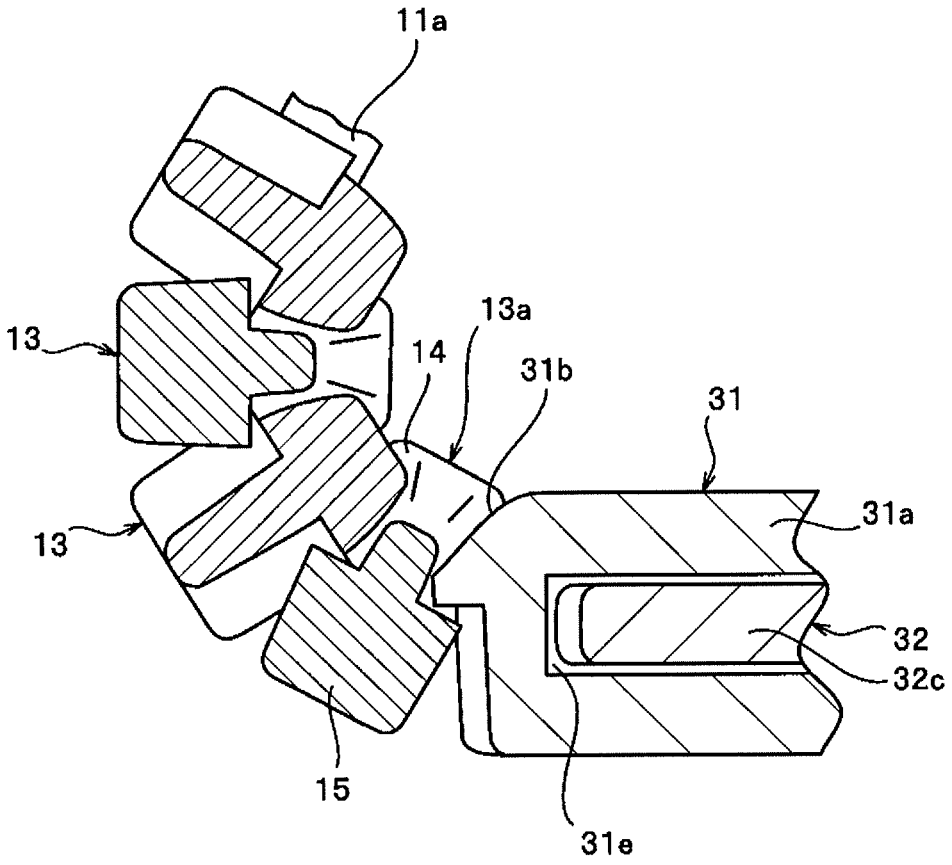
FIG. 6 is a portional view illustrating a state when the slide fastener is bent to a tape first surface side.

In the case, an upper surface of the insert pin main body 31*a* is disposed in parallel with a tape surface of the fastener tapes 11, as shown in FIGS. 4 and 6, and the inclined angle θof the first tapered portion 31*b* is formed by being inclined in a range equal to or more than 15° and less than 90° and preferably equal to or more than 20° and less than 45° to the upper surface of the insert pin main body 31*a*. In particular, in Embodiment 1, an inclined angle of the first tapered portion 31*b* to the upper surface of the insert pin main body 31*a* is set to 30°.

The projecting portion 31*c* in the insert pin 31 is disposed to an upper half portion side of the insert pin 31 and projects from a central portion of the insert pin 31 in the length direction toward the box pin 32 side in the direction of the tape width. A rear end surface of the projecting portion 31*c* is disposed so as to be orthogonal to the tape length direction and to be abutted to a stepped portion 32*d* of the box pin 32 to be described later when the insert pin 31 is inserted into the first and second sliders 21, 22 to engagement the right/left element rows 12. In the case, disposing the second tapered portion 31*d* on a rear side of the projecting portion 31*c* allows to stably form the rear end surface of the projecting portion 31*c*.

The accommodation concave portion 31*e* recessed to a side surface that faces the box pin of the insert pin 31 is configured to be able to accommodate an engaging convex portion 32*c* of the box pin 32 to be described later, and the accommodation of the engaging convex portion 32*c* of the box pin 32 in the accommodation concave portion 31*e* can determine a position of the insert pin 31 to the box pin 32.

The element engaging portion 31*f* of the insert pin 31 is disposed to a lower half portion of the insert pin 31 and projects from a front end of the first element 13*a* forward so as to be inserted into the neck portion of the first element 13*a* and capable of engaging the insert pin main body 31*a*. In the case, an upper surface of the element engaging portion 31*f* is configured in a flat surface.

The box pin 32 in Embodiment 1 is disposed adjacent to the element row 12 so as to be continuous from the rear end of the element row 12 in the second fastener stringer 10*b* on the right side and fixed across both the tape front/back surfaces of the fastener tapes 11. The box pin 32 is formed by injection molding the same synthetic resin material as the fastener element 13 such as polyacetal and the like.

Further, the box pin 32 has a box pin main body portion 32*a* fixed to the fastener tapes 11, a stopper portion 32*b* disposed to an upper/lower surface of a rear end portion of the box pin main body portion 32*a*, the engaging convex portion 32*c* projecting from a facing side edge facing the insert pin 31 on a front end side of the box pin main body portion 32*a* in the direction of the tape width, and the stepped portion 32*d* disposed rearward of the engaging convex portion 32*c*.

The stopper portion 32*b* in the box pin 32 has a thickness dimension larger than the interval between the upper/lower blades in the second slider 22 so as to be able to be abutted to a shoulder port side end of the second slider 22. The abutment of the second slider 22 to the stopper portion 32*b* regulates for the second slider 22 to slide rearward of the stopper portion 32*b* to thereby prevent the second slider 22 from falling from the second fastener stringer 10*b*.

The engaging convex portion 32*c* in the box pin 32 is projectingly disposed from a front end region on an insert pin facing a side surface of the box pin main body portion 32*a* external of the tape so as to be inserted into and accommodated in the accommodation concave portion 31*e* disposed to the insert pin 31. The engaging convex portion 32*c* is formed so as to exhibit an approximately triangular shape when viewed from the front surface side and further has an end edge disposed orthogonal to the tape length direction.

The stepped portion 32*d* in the box pin 32 is formed in an upper half portion of the box pin main body portion 32*a* by being cut out inward from a facing side edge of the insert pin 31 and is configured to be able to engage the projecting portion 31*c* disposed to the insert pin 31.

The stop 39 in Embodiment 1 is disposed to be continuous from a front end of the element row 12 in the first and second fastener stringers 10*a*, 10*b* and fixed across both the tape front/back surfaces of the fastener tapes 11.

The stop 39 is configured similar to a stop used in the conventional ordinary slide fastener 1 and is formed by injection molding a synthetic resin material such as polyacetal and the like. The provision of the stop 39 can regulate a slide of the first slider 21 and prevent the first slider 21 from falling from the second fastener stringer 10*b*.

In the slide fastener 1 of Embodiment 1 having the configuration described above, the both sides separable bottom end stop 30 is configured by the second slider 22, the insert pin 31, and the box pin 32 as described above. Accordingly, when the first and second right/left fastener stringers 10*a*, 10*b* cause the element rows 12 to be engaged with each other from a separated state, the second slider 22 is moved to a slide rear end position where it is abutted to the stopper portion 32*b* of the box pin 32 as well as the first slider 21 is moved to a position where it is abutted to the second slider 22.

Next, the insert pin 31 is inserted from a shoulder port of the first slider 21 into the element guide paths of the first and second sliders 21, 22. At the time, as illustrated in FIG. 3, the projecting portion 31*c* of the insert pin 31 is engaged with the stepped portion 32*d* of the box pin 32 as well as is, the engaging convex portion 32*c* of the box pin 32 is accommodated in the accommodation concave portion 31*e* of the insert pin 31, thereby the insert pin 31 is relatively positioned to the box pin 32.

Thereafter, sliding the first slider 21 forward toward the stop 39 can cause the right/left element rows 12 to be engaged with each other as illustrated in FIG. 1. Further, sliding the second slider 22 that is held by the box pin 32 forward toward the stop 39 from the state that the right/left element rows 12 are engaged can separate the right/left element rows 12.

In the slide fastener 1 of Embodiment 1, since the first tapered portion 31*b* is disposed as the escape portion in the front end region of the insert pin 31, when the element row 12 of the slide fastener 1 is bent into the U-shape to the upper surface side as illustrated in FIG. 6 from the state that the element rows 12 are engaged at the position adjacent to the insert pin 31 and the box pin 32 as illustrated in FIGS. 1 and 4, a space to which the first element 13*a* is escaped is secured by the first tapered portion 31*b*, so that the insert pin 31 can be avoided from interfering with the first element 13*a*.

In particular, in the slide fastener 1 of Embodiment 1, since the upper taper portions that function as the interference avoiding means are disposed to the element upper half portions 14 of the respective fastener elements 13, the insert pin 31 can be more securely avoided from interfering with the first element 13*a* as well as the element upper half portions 14 of the right/left fastener elements 13 are also avoided from interfering with each other. With the configuration, chain failure in the element rows 12 due to the interference between the insert pin 31 and the first element 13*a* can be effectively prevented and engaging of the right/left fastener elements 13 can be stably maintained.

Further, the slide fastener 1 of Embodiment 1 is strongly bent until a radius of curvature becomes small, even if the first tapered portion 31*b* of the insert pin 31 comes into contact with the upper taper portion of the first element 13*a*, since the first element 13*a* is not pressed by the insert pin 31 until it becomes to disengage with the fastener element 13 of the opponent, engagementing of the right/left fastener elements 13 can be maintained. Accordingly, the slide fastener 1 of Embodiment 1 becomes a high quality slide fastener to which chain failure scarcely occurs by bending the slide fastener 1.

Embodiment 2

Figure 7:
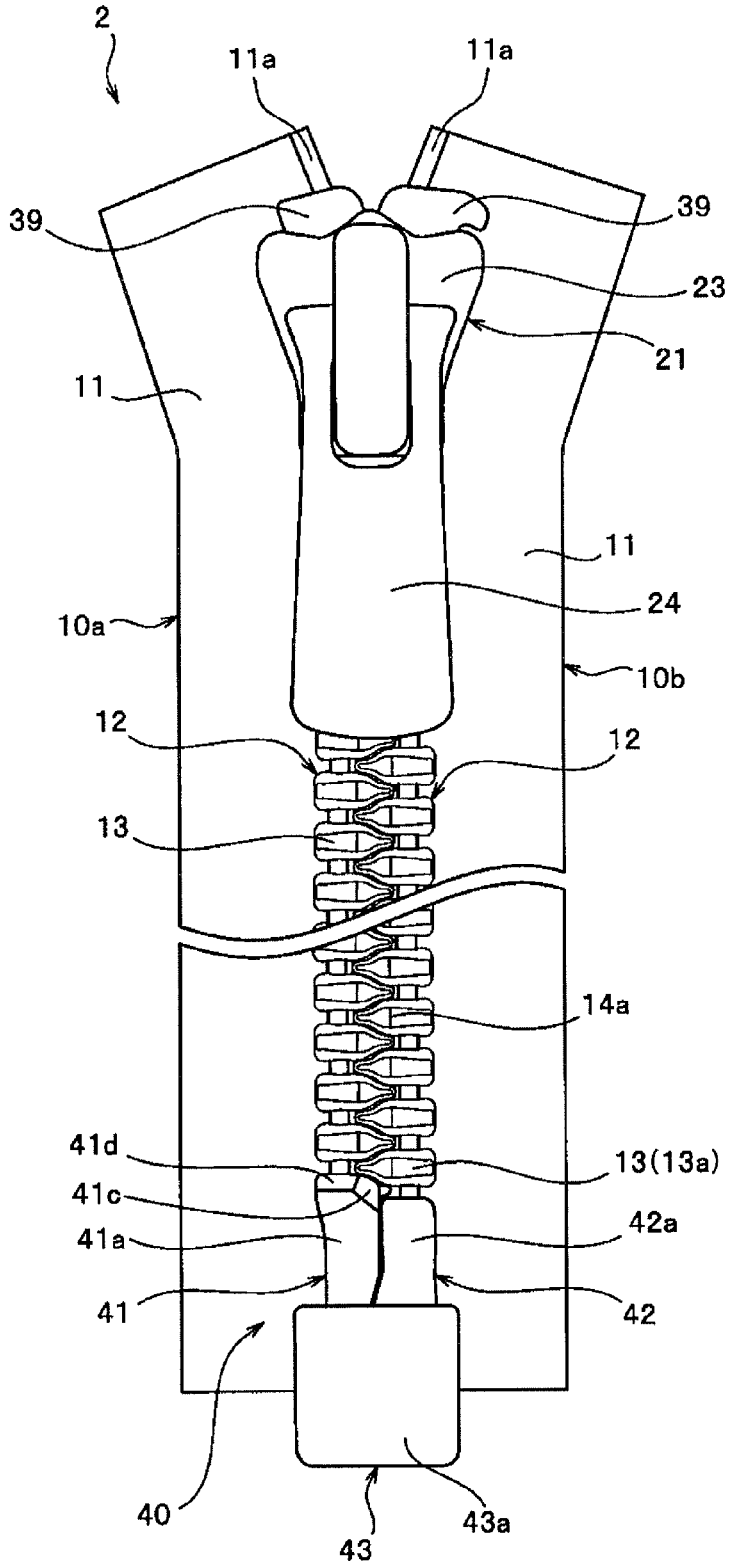
FIG. 7 is a front view illustrating a slide fastener according to Embodiment 2 of the invention.
Figure 8:
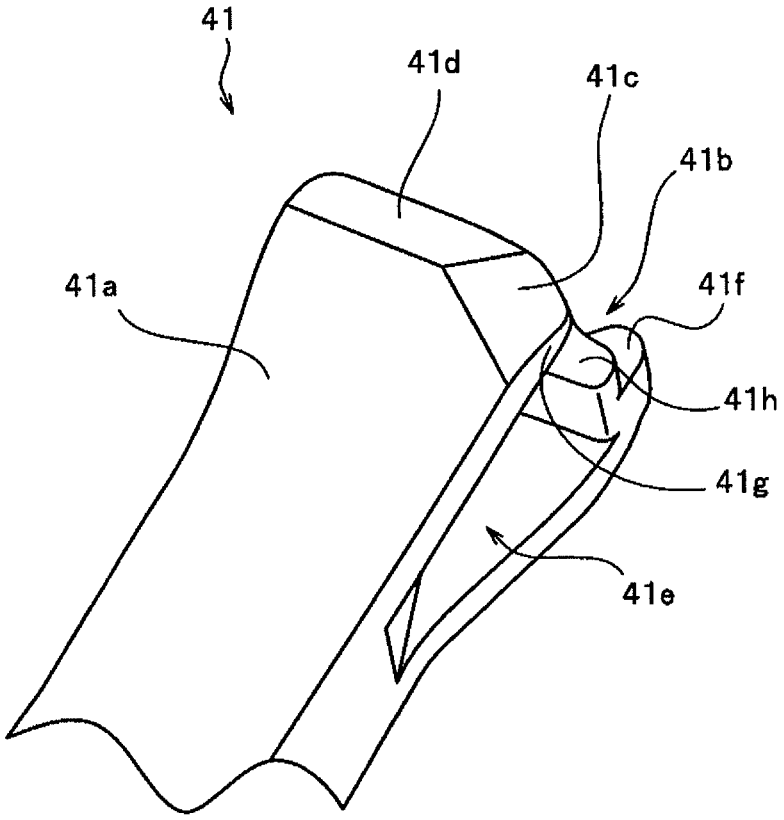
FIG. 8 is a perspective view illustrating a main portion of an insert pin disposed to the slide fastener.

FIG. 7 is a front view illustrating a slide fastener according to Embodiment 2, FIG. 8 is a perspective view illustrating a main portion of an insert pin disposed to the slide fastener. The slide fastener 2 according to Embodiment 2 is disposed with a first slider 21 for opening and engaging right/left element rows 12 and further a separable bottom end stop 40 is composed of an insert pin 41, a box pin 42, and a box 43 as described later, and a configuration of the slide fastener 2 other than the above configuration is substantially the same as that of the slide fastener 1 according to Embodiment 1. Accordingly, an explanation of Embodiment 2 is omitted by denoting the components having the same configuration as those of the slide fastener 1 of Embodiment 1 described above by the same reference numerals.

A slide fastener 2 according to Embodiment 2 includes a pair of first and second right/left fastener stringers 10*a*, 10*b* having element rows 12 disposed to facing tape side edges of right/left fastener tapes 11, a first slider 21 slidably disposed along the element rows 12, an insert pin 41 disposed to a lower end of the first left fastener stringer 10*a*, a box pin 42 disposed to a lower end of the second right fastener stringer 10*b*, a box 43 integrated to a lower end of the box pin 42, and a stop 39 attached to upper ends of the first and second fastener stringers 10*a*, 10*b* along the element rows 12. In the case, a separable bottom end stop 40 of the slide fastener 2 is composed of the insert pin 41, the box pin 42, and the box 43.

The first slider 21 in Embodiment 2 is configured similar to the first slider 21 in Embodiment 1 described above and disposed to engage the right/left element rows 12 when slid toward the stop 39 side. Note that in the slide fastener 2 in Embodiment 2, the second slider 22 disposed to the slide fastener 1 of Embodiment 1 described above is excluded.

The insert pin 41 in Embodiment 2 is disposed so as to be continuous from rear ends of the element rows 12 in the first stringer 10*a* and is fixed across both tape front/back surfaces of the fastener tapes 11.

Further, the insert pin 41 includes an insert pin main body 41*a* fixed to the fastener tapes 11, a first tapered portion 41*c* disposed to a front-end corner portion on a side edge that faces the box pin side on an upper surface side of the insert pin main body 41*a*, a notch portion 41*b* disposed nearer to the side edge side that faces the box pin than the first tapered portion 41*c* in the front-end corner portion of the insert pin main body 41*a*, a second tapered portion 41*d* disposed inside of a tape of the front end in the insert pin main body 41*a*, an accommodation concave portion 41*e* recessed in a tape width direction from the side surface that faces the box pin in the front end of the insert pin main body 41*a*, and an element engaging portion 41*f* projecting forward from the front end of the insert pin main body 41*a*.

The first tapered portion 41*c* in the insert pin 41 is disposed as the escape portion in a front end region within 10% from a front end edge of the insert pin 41 in a tape length direction. The first tapered portion 41*c* has an inclination which decreases the thickness dimension of the insert pin 41 in a tape front/back direction in the direction of the tape width toward the side edge that faces the box pin as well as also in a tape length direction toward an insert pin front end edge. With the configuration, a reduction of thickness dimension of an upper half portion of the insert pin 41 allows the first tapered portion 41*c* to be used as an interference avoiding means for avoiding the insert pin 41 from interfering with the first element 13*a* each other.

In the case, the first tapered portion 41*c* is formed inclining in a range equal to or more than 15° and less than 90° and preferably in a range equal to or more than 20° and equal to or less than 45° to an upper surface of the insert pin main body 41*a*. In particular, in Embodiment 1, an inclined angle of the first tapered portion 41*c* to an upper surface of the insert pin main body 41*a* is set to 30°.

The notch portion 41*b* in the insert pin 41 is configured by cutting out an upper half portion of the insert pin main body 41*a* from the side edge that faces the box pin in a tape width direction. The disposition of the notch portion 41*b* forms a notch side surface 41*g* and a notch bottom surface 41*h* nearer to the side edge that faces the box pin than the first tapered portion 41*c*, thereby a step is formed between the first tapered portion 41*c* and the bottom surface 41*h* via the notch side surface 41*g* in an up/down direction as well as a space portion without a synthetic resin is formed on the bottom surface 41*h*. In the case, the notch side surface 41*g* of the notch portion 41*b* constitutes a part of the side surface that faces the box pin in the upper half portion of the insert pin 41.

The notch portion 41*b* disposed adjacent to the side edge side that faces the box pin of the first tapered portion 41*c* functions as the interference avoiding means for avoiding the insert pin 41 from interfering with the first element 13*a* together with the first tapered portion 41*c*. In the insert pin 41 of Embodiment 2, the first tapered portion 41*c* and the notch portion 41*b* that function as the interference avoiding means are disposed in the front end region within 10% from the front end edge of the insert pin 41 in the tape length direction.

The second tapered portion 41*d* in the insert pin 41 is disposed to the front end of the insert pin main body 41*a* adjacent to the inside of the tape of the first tapered portion 41*c*. The second tapered portion 41*d* has an inclination which gradually decreases the thickness dimension of the insert pin 41 in the tape front/back direction toward the insert pin front end edge in the tape length direction and configured as a chamfering portion of the insert pin 41.

The accommodation concave portion 41*e* recessed to the side surface that faces the box pin of the insert pin 41 is configured so as to be able to accommodate an engaging convex portion of the box pin 42 to be described later, and accommodating the engaging convex portion of the box pin 42 in the accommodation concave portion 41*e* can position the insert pin 41 to the box pin 42.

The element engaging portion 41*f* of the insert pin 41 is disposed to a lower half portion of the insert pin 41 and projects from the front end of the insert pin main body 41*a* forward so as to be inserted into a neck portion of the first element 13*a* and engaged with the first element 13*a*. In the case, an upper surface of the element engaging portion 41*f* is configured in a flat surface.

The box pin 42 in Embodiment 2 is disposed so as to continue from a rear end of the element row 12 in the second fastener stringer 10*b* and fixed across both tape front/back surfaces of the fastener tapes 11. The box pin 42 has a box pin main body 42*a* fixed to the fastener tapes 11 and a not illustrated engaging convex portion projecting from a facing side edge facing the insert pin 41 on the front end side of the box pin main body 42*a*.

The box 43 in Embodiment 2 is disposed to the lower end of the box pin 42. The box 43 has a box main body 43*a* which exhibits an approximately rectangular shape when viewed from a front surface side and an insert pin insertion hole formed to a left half portion of the box main body 43*a* from an upper surface side.

As described above, in the slide fastener 2 of Embodiment 2 having the configuration described above, the one side open (front open) separable bottom end stop 40 is composed of the insert pin 41, the box pin 42 and the box 43. Accordingly, when the element rows 12 are engaged from a state that the first and second right/left fastener stringers 10*a*, 10*b* are separated from each other, first, the first slider 21 is moved backward up to a slide rear end position where the first slider 21 is abutted to the box 43.

Next, the insert pin 41 is inserted into the insert pin insertion hole of the box 43 from a shoulder port of the first slider 21 via an element guide path of the first slider 21. At the time, accommodating the engaging convex portion of the box pin 42 in the accommodation concave portion 41*e* of the insert pin 41 relatively positions the insert pin 41 to the box pin 42. Thereafter, sliding the first slider 21 forward toward the stop 39 can engage the right/left element rows 12 as illustrated in FIG. 7.

In the slide fastener 2 of embodiment 2, the first tapered portion 41*c* is disposed to the front end of the insert pin 41 as the escape portion as well as the notch portion 41*b* is disposed adjacent to the side edge side that faces the box pin of the first tapered portion 41*c*. With the configuration, when the element rows 12 are bent into the U-shape to the upper surface side at positions adjacent to the insert pin 41 and the box pin 42 in the state that the element rows 12 are engaged, since a large space for causing the first element 13*a* to escape is secured by the first tapered portion 41*c* and the notch portion 41*b*, an interference between the insert pin 41 and the first element 13*a* can be more effectively avoided than Embodiment 1 described above. Accordingly, an occurrence of chain failure in the element rows 12 at the positions adjacent to the insert pin 41 and the box pin 42 can be effectively prevented, so that a engaged state between the right/left fastener elements 13 can be stably maintained.

DESCRIPTION OF REFERENCE NUMERALS

1 slide fastener
2 slide fastener
10*a* first fastener stringer
10*b* second fastener stringer
11 fastener tape
11*a* core thread portion
12 element row
13 fastener element
13*a* first element
14 element upper half portion
14*a* inclination start portion
15 element lower half portion
21 first slider
22 second slider
23 slider body
24 tab
30 separable bottom end stop
31 insert pin
31 insert pin main body
31*b* first tapered portion
31*c* projecting portion
31*d* second tapered portion
31*e* accommodation concave portion
31*f* element engaging portion
32 box pin
32*a* box pin main body
32*b* stopper portion
32*c* engaging convex portion
32*d* stepped portion
39 stop
40 separable bottom end stop
41 insert pin
41 insert pin main body
41*b* notch portion
41*c* first tapered portion
41*d* second tapered portion
41*e* accommodation concave portion
41*f* element engaging portion
41*g* notch side surface
41*h* notch bottom surface
42 box pin
42*a* box pin main body
43 box
43*a* box main body

The invention claimed is:

1. A slide fastener with separable bottom end stop comprising:

a pair of first and second fastener stringers in which having element rows are disposed wherein a plurality of fastener elements made of synthetic resin are molded along a tape length direction at predetermined intervals at facing respective tape side edges of first and second fastener tapes; and separable bottom end stop disposed to one end of each of the first and second fastener stringers, the separable bottom end stop including:

at least an insert pin attached adjacent to the element row of the first fastener stringer; and a box pin attached adjacent to the element row of the second fastener stringer, wherein at least a corner portion of a front end of the insert pin on a facing side edge side that faces the second fastener stringer includes an escape portion which avoids interference with a fastener element disposed adjacent to the box pin when the fastener elements are coupled, and the escape portion has an inclined surface which declines downward or a concave curved surface, and a thickness dimension of the insert pin in a tape front/back direction gradually decreases continuously from a main body portion towards a front end edge of the insert pin.

2. The slide fastener with separable bottom end stop according to claim 1 wherein the escape portion is configured so as to exhibit an approximately triangular shape including the front end edge on an element row side and a facing side edge as two sides when the insert pin is viewed from a first surface side.

3. The slide fastener with separable bottom end stop according to claim 1 wherein the escape portion is disposed in a front end region within 10% of the entire length of the insert pin in the tape length direction from the front end edge on an element row side in the insert pin.

4. The slide fastener with separable bottom end stop according to claim 1 wherein an inclined angle of the inclined surface or the curved surface of the escape portion is set equal to or more than 15° and less than 90° with respect to a first surface of the insert pin.

5. The slide fastener with separable bottom end stop according to claim 1 wherein a notch portion including a notch bottom surface is disposed via a step in a part of the corner portion that faces the second fastener stringer.

6. The slide fastener with separable bottom end stop according to claim 1 wherein a dimension of the fastener element in the tape front/back direction gradually decreases along an inclined surface of the fastener element as the inclined surface extends toward a forefront portion of a head of the fastener element in the tape width direction.

7. The slide fastener with separable bottom end stop according to claim 1, wherein a dimension of the escape portion of the front end of the insert pin in the tape front/back direction gradually decreases as the escape portion extends toward the front end edge in the tape length direction throughout the tape width direction of the escape portion.

* * * * *